US007715763B2

(12) United States Patent
Yoshida

(10) Patent No.: US 7,715,763 B2
(45) Date of Patent: May 11, 2010

(54) DEVELOPMENT DEVICE, AND PROCESS CARTRIDGE AND IMAGE FORMING APPARATUS INCLUDING DEVELOPMENT DEVICE

(75) Inventor: Satoru Yoshida, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 246 days.

(21) Appl. No.: 11/867,425

(22) Filed: Oct. 4, 2007

(65) Prior Publication Data

US 2008/0085138 A1 Apr. 10, 2008

(30) Foreign Application Priority Data

Oct. 4, 2006 (JP) ..... 2006-273096

(51) Int. Cl.
*G03G 15/08* (2006.01)

(52) U.S. Cl. ..... 399/254

(58) Field of Classification Search ..... 399/254, 399/119, 222, 252, 256, 284
See application file for complete search history.

(56) References Cited

U.S. PATENT DOCUMENTS

| | | | | |
|---|---|---|---|---|
| 5,991,583 | A * | 11/1999 | Nozawa | 399/254 |
| 6,259,876 | B1 * | 7/2001 | Fukuda et al. | 399/254 |
| 6,516,174 | B1 * | 2/2003 | Aoki et al. | 399/284 |
| 2006/0008297 | A1 | 1/2006 | Oyama et al. | |
| 2006/0204283 | A1 | 9/2006 | Yasuda | |
| 2007/0160392 | A1 | 7/2007 | Tsuda et al. | |

FOREIGN PATENT DOCUMENTS

| | | |
|---|---|---|
| JP | 10-69155 | 3/1998 |
| JP | 11-167260 | 6/1999 |
| JP | 2002-72642 | 3/2002 |
| JP | 2002-148921 | 5/2002 |
| JP | 2005-173543 | 6/2005 |
| JP | 2006-201753 | 8/2006 |

OTHER PUBLICATIONS

U.S. Appl. No. 11/612,865, filed Dec. 19, 2006, Kiyonori Tsuda, et al.
U.S. Appl. No. 12/110,055, filed Apr. 25, 2008, Sakata, et al.
U.S. Appl. No. 12/238,815, filed Sep. 26, 2008, Utsunomiya, et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A development device includes a developer carrying member, developer collection conveyance path, and developer supply conveyance path. The developer carrying member carries a developer to develop an image on a latent image carrier. The developer collection conveyance path disposed obliquely above the developer carrying member conveys the developer in a first direction. The developer supply conveyance path disposed below the developer collection conveyance path conveys the developer in a second direction. The developer collection conveyance path and developer supply conveyance path have first and second openings and third and fourth openings respectively within a development region. The developer located downstream of the developer collection conveyance path is transferred to upstream of the developer supply conveyance path through the first and third openings. The developer located downstream of the developer supply conveyance path is transferred to upstream of the developer collection conveyance path through the fourth and second openings.

7 Claims, 7 Drawing Sheets

BACKGROUND

BACKGROUND

BACKGROUND

BACKGROUND

DEVELOPMENT DEVICE, AND PROCESS CARTRIDGE AND IMAGE FORMING APPARATUS INCLUDING DEVELOPMENT DEVICE

CROSS-REFERENCE TO RELATED APPLICATION

This application is based on and claims priority from Japanese Patent Application No. 2006-273096 filed on Oct. 4, 2006 in the Japan Patent Office, the entire contents of which are incorporated by reference herein.

BACKGROUND

Field of the Invention

Exemplary aspects of the present invention relate to a development device. More particularly, the present invention relates to a development device developing an electrostatic image with a developer having toner and carrier to form a toner image, and a process cartridge and an image forming apparatus including the development device.

Description of the Related Art

Image forming apparatuses of recent years are expected to reliably produce high quality images with uniform image density even when images with high image area ratios are successively printed succession. In attempting to fulfill this requirement, an image forming apparatus including a development device having a developer conveyance mechanism is proposed that feeds a developer vertically, unlike conventional development devices that feed a developer horizontally. An example of such image forming apparatus is shown in FIG. 1.

Referring to FIG. 1, a related-art development device 71 includes a development casing 72, a doctor 73, a developer carrying member 74, a developer supply mechanism 75, a developer agitation conveyance mechanism 76, and a developer collection mechanism 77. A photoconductor drum 78 is disposed in the vicinity of the development device 71.

The doctor 73 controls the thickness of a developer carried on the developer carrying member 74 in order to supply a suitable amount of the developer to the photoconductor drum 78 for developing an electrostatic latent image thereon. After development of the electrostatic latent image, the developer, which has been used for a development process at least once, is collected by the developer collection mechanism 77 and is conveyed in a direction of from rear to front in FIG. 1. Thus, the collected developer is supplied to the developer agitation conveyance mechanism 76 through a first opening, not shown, that is disposed within a development region HH shown in FIG. 2. A toner supply mechanism, not shown, disposed above the developer agitation conveyance mechanism 76 and in the vicinity of the first opening properly supplies additional toner to the developer agitation conveyance mechanism 76 so as to increase the toner density to a desirable level. The developer agitation conveyance mechanism 76 conveys the collected developer and the additional toner to the rear side of FIG. 1 while mixing the two together.

The developer agitation conveyance mechanism 76 has a second opening A at a downmost stream side thereof relative to the developer conveyance direction to communicate with the developer supply mechanism 75 as shown in FIG. 2. Specifically, the developer agitation conveyance mechanism 76 supplies the developer to the developer supply mechanism 75 though the second opening A located within the development region HH. Subsequently, the developer supply mechanism 75 supplies the developer to the developer carrying member 74 from an upstream side to the downstream side thereof. As shown in FIG. 2, the developer supply mechanism 75 has a third opening B at a downmost stream side thereof relative to the developer conveyance direction to communicate with the developer agitation conveyance mechanism 76. Therefore, the developer supply mechanism 75 can supply the developer to the developer agitation conveyance mechanism 76 through the third opening B located within the development region HH.

However, the related-art development device 71 can frequently cause developer accumulation in the vicinity of the first opening through which the developer collection mechanism 77 communicates with the developer agitation conveyance mechanism 76. Consequently, as shown in FIG. 3, the developer mechanism 77 can frequently cause excess supply of the developer at the downstream side thereof relative to the developer conveyance direction. In this case, the developer is supplied within the development region HH and the collected developer having a low density is fed into the developer carrying member 74, resulting in formation of an image of uneven density.

One example attempts to arrange an opening outside a development region of a development device to supply developer to each developer conveyance mechanism. Such a disposition of the opening can reduce the risk of low density developer being supplied to a developer carrying member. However, such a development device needs to increase the length of each of the developer conveyance mechanisms in a developer conveyance direction by the length of the opening, which increases the size of the developer carrying member, resulting in a larger size of the development device and in an image forming apparatus as a whole, which is undesirable.

SUMMARY

According to one aspect of the invention, a development device includes a developer carrying member, developer collection conveyance path, and a developer supply conveyance path. The developer carrying member rotates while bearing thereon developer including toner and carrier to carry the developer to a development region, in which the developer carrying member faces a latent image carrier, to develop a latent image on the latent image carrier. The developer collection conveyance path includes a developer collection conveyance member collecting the developer from the developer carrying member after the developer on the developer carrying member passes through the development region. The developer collection conveyance path is disposed obliquely above the developer carrying member and conveys the collected developer in a first direction parallel to an axis of the developer carrying member. In addition, the developer collection conveyance path has first and second openings within the development region. The developer supply conveyance path includes a developer supply conveyance member supplying the developer to the developer carrying member. The developer supply conveyance path is disposed below the developer collection conveyance path and conveys the developer in a second direction opposite to the first direction. The developer supply conveyance path has third and fourth openings within the development region. The developer on a downstream side of the developer collection conveyance path conveyed by the developer collection conveyance path is transferred to an upstream side of the developer supply conveyance path through the first and third openings. The developer on a downstream side of the developer supply conveyance path conveyed by the developer supply conveyance path is transferred to an upstream side of the developer collection conveyance path through the fourth and second openings.

According to another aspect of the present invention, a process cartridge is detachably installed in an image forming apparatus. The process cartridge includes at least one member selected from a latent image carrier carrying a latent image thereon, a charging member charging the latent image carrier, and a cleaning member cleaning a surface of the latent image carrier, and a development device configured to develop the latent image on the latent image carrier with developer including toner and carrier.

According to yet another aspect of the present invention, an image forming apparatus includes a latent image carrier carrying a latent image thereon and a development device developing the latent image on the latent image carrier with developer including toner and carrier.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
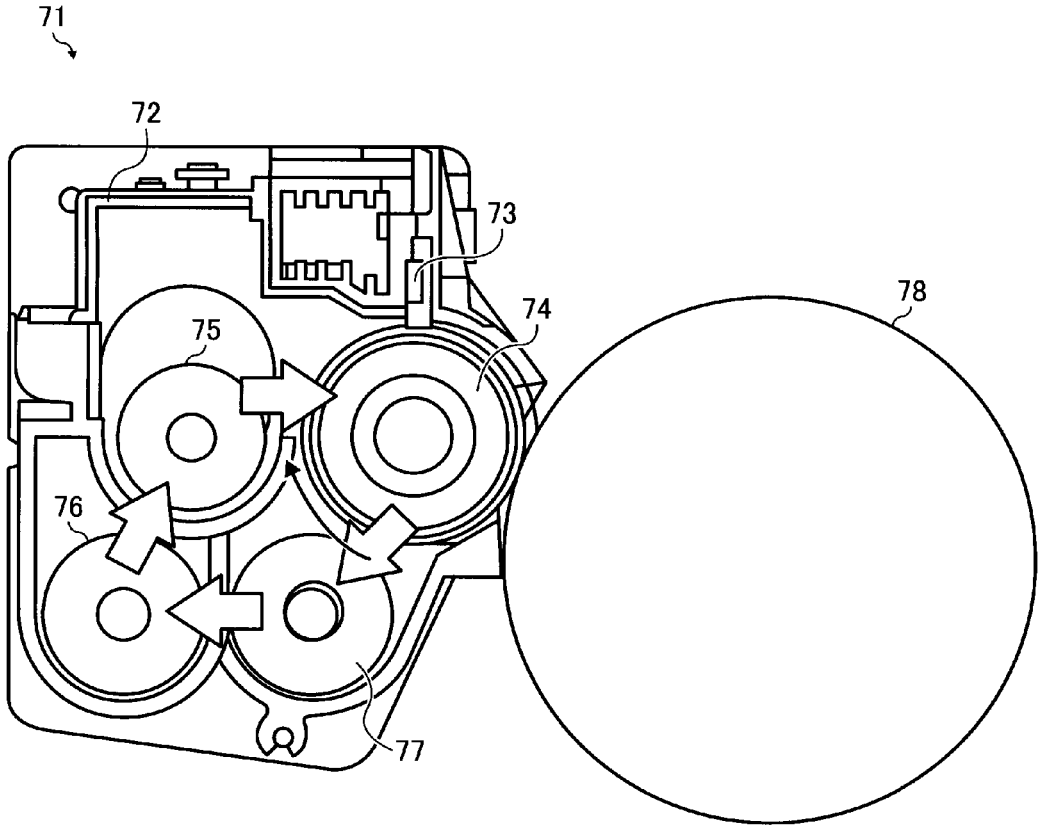
FIG. 1 is a schematic diagram illustrating a related-art development device.
Figure 2:
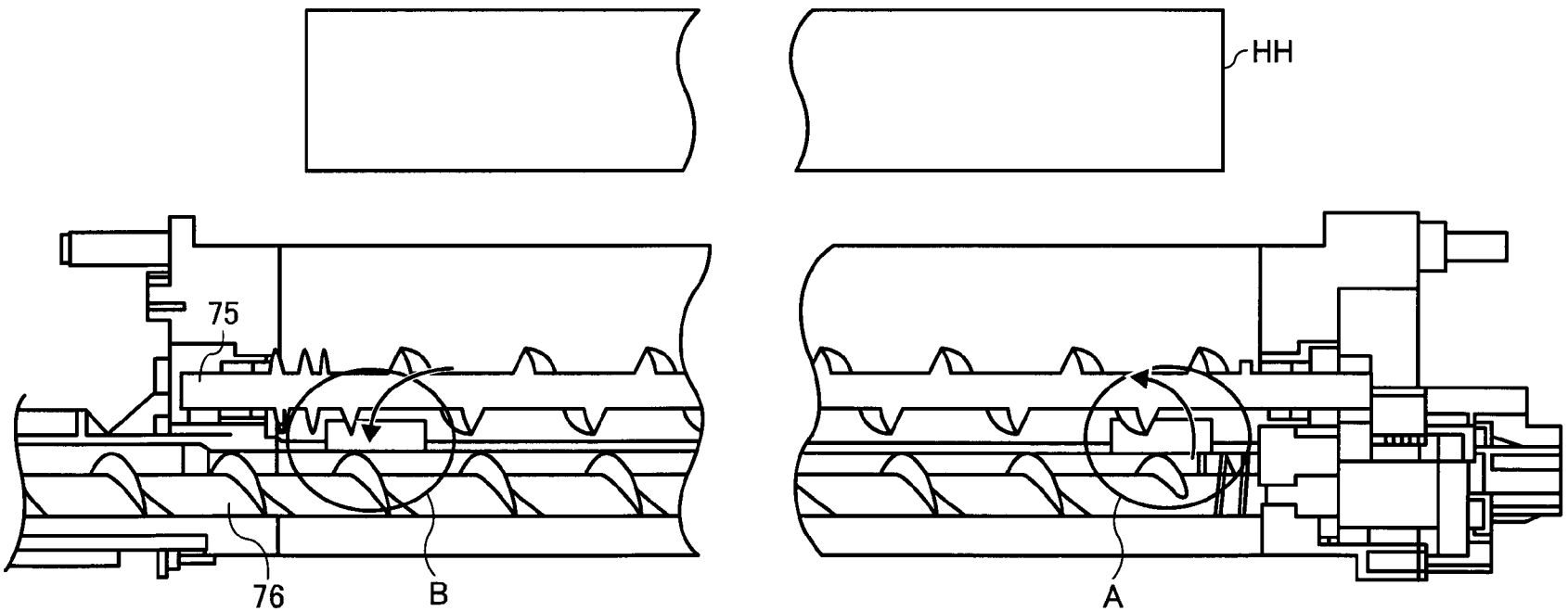
FIG. 2 is a cross-sectional view illustrating the related-art development device of FIG. 1.
Figure 3:
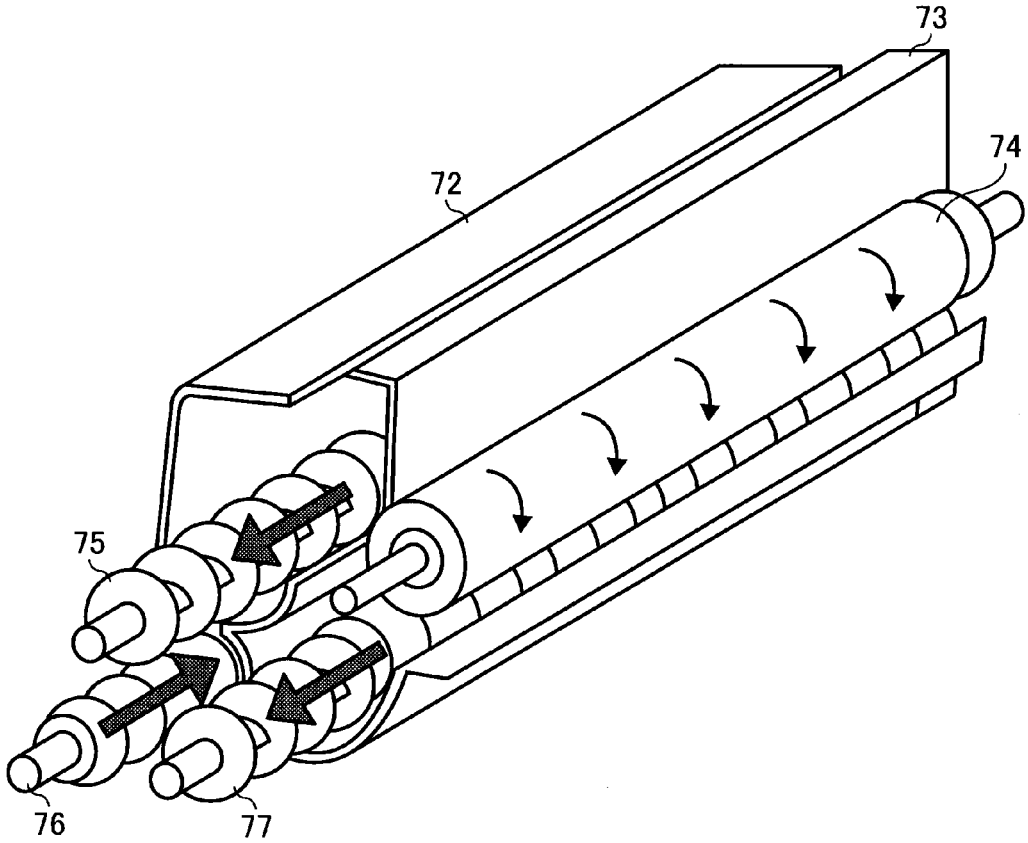
FIG. 3 is a schematic perspective view illustrating a flow of developer in the related-art development device of FIG. 2

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views thereof, an image forming apparatus according to an exemplary embodiment of the present invention is described.

Figure 4:
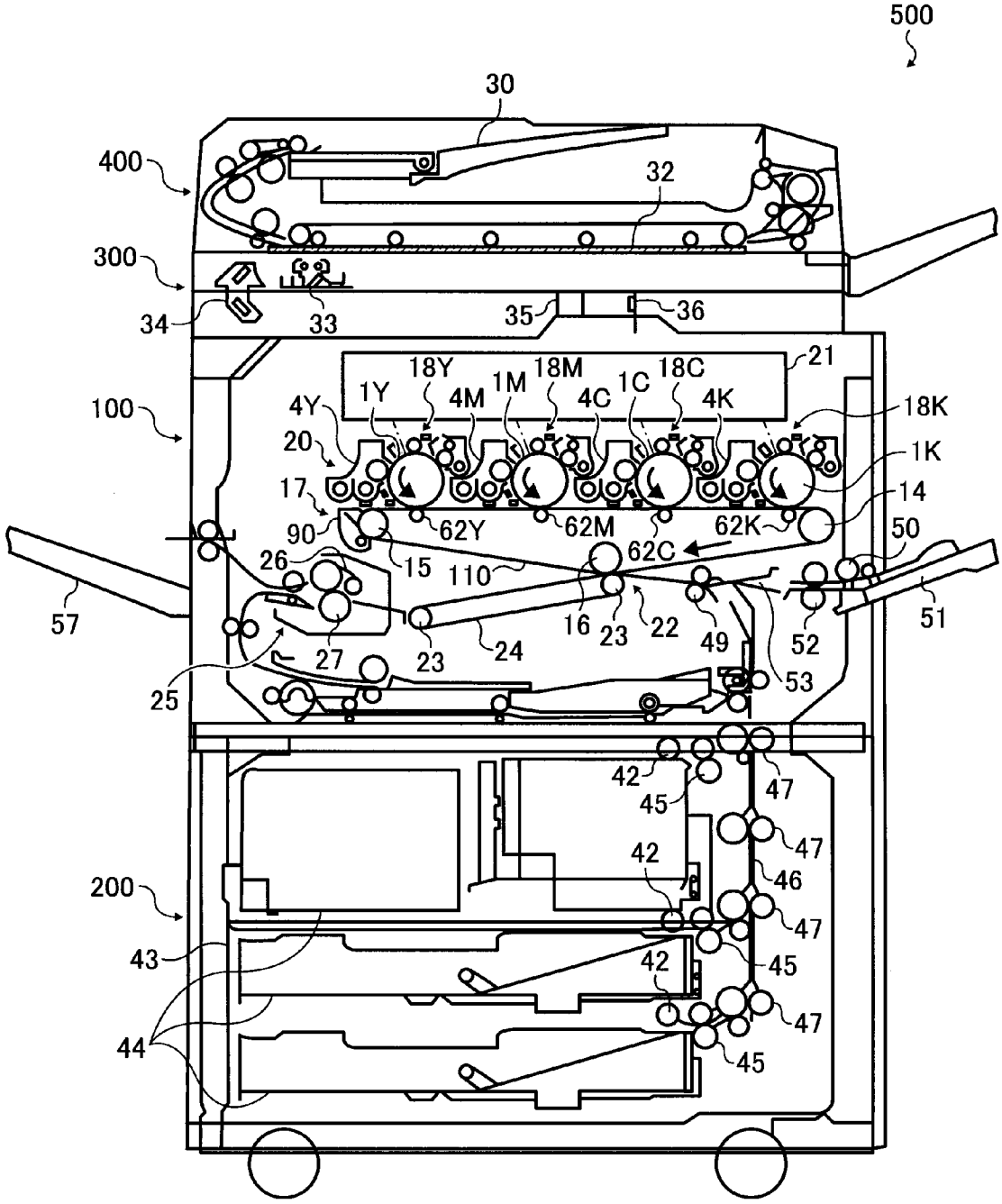
FIG. 4 is a schematic diagram illustrating an image forming apparatus according to an exemplary embodiment of the present invention.

Referring to FIG. 4, a tandem image forming apparatus 500 having four photoconductor drums 1Y, 1M, 1C and 1K for four colors is illustrated. The image forming apparatus 500 includes a printing unit 100, a sheet feeder 200, a scanner 300 and an automatic document feeder 400.

The printing unit 100 includes an optical writing unit 21, an image forming unit 20, an intermediate transfer unit 17, a secondary transfer device 22, a pair of registration rollers 49, and a fixing device 25.

The optical writing unit 21 includes an optical source, not shown, a polygon mirror, not shown, a fθ lens, not shown, and a reflection mirror, not shown. The optical writing unit 21 writes an electrostatic latent image, for example, on the photoconductor drum 1Y serving as a latent image carrier, with a laser beam that is formed based on image data. The optical writing unit 21 will be described in detail later.

The image forming unit 20 includes four process cartridges 18Y, 18M, 18C and 18K for the four colors, yellow, magenta, cyan and black, which are abbreviated as Y, M, C and K, respectively. The color abbreviations may be omitted as necessary. As the process cartridges 18Y, 18M, 18C and 18K are substantially similar to one another except for the color of the toner, the one process cartridge 18Y is described as representative of all the process cartridges 18Y, 18M, 18C and 18K.

The process cartridge 18Y includes the photoconductor drum 1Y, a charging device, not shown, a development device 4Y, a drum cleaning device, not shown, and a discharger, not shown.

The charging device of the process cartridge 18Y uniformly charges a surface of the photoconductor drum 1Y. The optical writing unit 21 modulates and deflects the laser beam to irradiate the surface of the photoconductor drum 1Y so that the potential of an irradiated area of the photoconductor drum 1Y decays, thereby forming the electrostatic latent image on the surface of the photoconductor drum 1Y. The development device 4Y develops the electrostatic latent image on the photoconductor drum 1Y with a developer including a yellow toner to form a yellow toner image Y.

The toner image Y on the photoconductor drum 1Y is primarily transferred onto an intermediate transfer belt 110 that will be described later. The drum cleaning device removes a remaining toner from the surface of the photoconductor drum 1Y. The discharger discharges the photoconductor drum 1Y, thereby initializing the photoconductor drum 1Y. The charging device uniformly charges the photoconductor drum 1Y to form the next image. Similarly, the processes cartridges 18M, 18C and 18K execute a series of operations in the image forming process, such as charging, writing, developing, transferring, cleaning and discharging.

The intermediate transfer unit 17 includes the intermediate transfer belt 110, a belt cleaning device 90, a tension roller 14, a drive roller 15, a secondary transfer backup roller 16 and primary transfer bias rollers 62Y, 62M, 62C and 62K.

The intermediate transfer belt 110 is tightly stretched by a plurality of rollers including the tension roller 14, and rotates clockwise with an endless movement. The drive roller 15 is driven by a belt driving motor, not shown, so as to drive the intermediate transfer belt 110 to rotate.

Each of the primary transfer bias rollers 62Y, 62M, 62C and 62K is disposed in such a manner as to contact an inner circumference side of the intermediate transfer belt 110, thereby applying a primary transfer bias thereto from a power source, not shown. The primary transfer bias rollers 62Y, 62M, 62C and 62K press the inner circumference side of the intermediate transfer belt 110 toward the photoconductor drums 1Y, 1M, 1C and 1K to form primary transfer nips. The application of the primary transfer bias generates a primary transfer electrical field in each of the primary transfer nips. For example, the photoconductor drum 1Y and the primary transfer bias roller 62Y have the primary transfer electrical field therebetween.

The toner image Y formed on the photoconductor drum 1Y is primarily transferred onto the intermediate transfer belt 110 by the primary transfer electrical field and nip pressure. Similarly, toner images M, C and K formed on respective photoconductors drums 1M, 1C and 1K are primarily transferred onto the intermediate transfer belt 110. In other words, a four-color image is formed on the intermediate transfer belt 110 by superimposition of each color image.

The four-color image on the intermediate transfer belt 110 is secondarily transferred onto a transfer sheet as a recording sheet, not shown, at a secondary transfer nip described later. After the intermediate transfer belt 110 passes the secondary nip, the belt cleaning device 90 removes the remaining toner from the surface of the intermediate transfer belt 110.

The secondary transfer device 22 is disposed below the intermediate transfer unit 17 and includes a sheet conveyance belt 24 and secondary transfer tension rollers 23. The sheet conveyance belt 24 is tightly stretched by the secondary transfer tension rollers 23 and rotates counterclockwise with rotation of at least one of the secondary transfer tension rollers 23. One of the secondary transfer rotation rollers 23 disposed at a right-hand side of FIG. 4 and the secondary transfer backup roller 16 sandwich the intermediate transfer belt 110 and the sheet conveyance belt 24 therebetween. In other words, the intermediate transfer belt 110 and the sheet conveyance belt 24 contact each other at the secondary transfer nip. The power source applies a secondary transfer bias having a polarity opposite that of a charge of the toner to the secondary transfer tension roller 23 disposed at the right-hand side. The application of the secondary transfer bias forms a secondary transfer electrical field in the secondary transfer nip. The four-color image on the intermediate transfer belt 110 is transferred by the secondary transfer electrical field toward the secondary transfer tension roller 23 disposed at the right-hand side of FIG. 4. The pair of registration rollers 49 registers the transfer sheet to feed into the secondary transfer nip in such a manner as to be in sync with the four-color image on the intermediate transfer belt 110. The four-color image is secondary transferred onto the transfer sheet by the secondary transfer electrical field and the nip pressure.

It should be noted that, although the exemplary embodiment of the present invention employs the secondary transfer system to apply the secondary transfer bias to one of the secondary transfer tension rollers 23, alternatively a charger may be employed to charge the transfer sheet in a non-contact manner, substituting for the secondary transfer system.

The image forming apparatus 500 includes the sheet feeder 200 at a lower portion thereof as shown in FIG. 4. The sheet feeder 200 includes a plurality of sheet cassettes 44, sheet feed rollers 42, a feed path 46, a sheet bank 43 and sheet separation rollers 45. Each of the sheet cassettes 44 stores a plurality of transfer sheets therein. The plurality of sheet cassettes 44 are disposed one above another in a vertical direction. Each of the sheet cassettes 44 presses an uppermost sheet against the corresponding sheet feed roller 42 so that the uppermost sheet is fed toward the feed path 46 by rotation of the sheet feed roller 42.

Subsequently, the transfer sheet is conveyed toward the registration rollers 49 through the feed path 46 including a plurality of conveyance rollers 47. The registration rollers 49 are disposed near one end of the feed path 46. For example, when the four-color image on the intermediate transfer belt 110 is put into the secondary transfer nip by an endless movement of the intermediate transfer belt 110, the pair of registration rollers 49 sandwich the transfer sheet therebetween and feed it in sync with the four-color image on the intermediate transfer belt 110. The four-color image is affixed to the transfer sheet at the secondary transfer nip and is secondarily transferred, thereby forming a full color image on the transfer sheet. The transfer sheet with the full color image is fed out from the secondary transfer nip with rotation of the sheet conveyance belt 24 and is conveyed to the fixing device 25.

The fixing device 25 of the printing unit 100 includes a belt unit and a pressure roller 27. The belt unit includes a fixing belt 26 and two rollers. The fixing belt 26 is tightly stretched by the two rollers and rotates endlessly. The pressure roller 27 presses one of the two rollers. The fixing belt 26 and the pressure roller 27 contact each other so as to form a fixing nip in which the transfer sheet conveyed from the sheet conveyance belt 24 is nipped. One of the two rollers pressed by the pressure roller 27 includes a heat source, not shown, therein to heat the fixing belt 26. The heated fixing belt 26 heats the transfer sheet nipped at the fixing nip. Therefore, the full color image is affixed to the transfer sheet by the heat and the nip pressure.

The fixing device 25 fixes the full color toner image on the transfer sheet, and the transfer sheet is stacked on a stacking area 57 disposed at a left-hand side of the image forming apparatus 500. When a toner image is formed on another side of the transfer sheet, the transfer sheet is returned to the secondary transfer nip.

The image forming apparatus 500 includes the automatic document feeder 400 disposed above the scanner 300 as shown in FIG. 4. The automatic document feeder 400 includes an original table 30. When the image forming apparatus 500 is used to make a copy, for example, an original bunch is placed on the original table 30. However, when one side of an original is bound like a book, the automatic document feeder 400 is opened with respect to the image forming apparatus 500, and the original is placed on a contact glass 32 of the scanner 300. This opening of the automatic document feeder 400 exposes the contact glass 32. The original on the contact glass 32 is held in place by closing the automatic document feeder 400.

The scanner 300 includes the contact glass 32, a first traveling body 33, a second traveling body 34, an imaging lens 35 and a reading sensor 36. The first traveling body 33 includes a light source, not shown, and the second traveling body 34 includes a mirror, not shown.

The scanner 300 reads the original on the contact glass 32 by pressing a start switch, referred to as an original reading operation. When the original is placed on the original table 30, the original is automatically transferred to the contact glass 32 so as to be read by the scanner 300. During the original reading operation, the first and second traveling bodies 33 and 34 begin to travel, and the light source in the first traveling body 33 emits the light that is reflected from a surface of the original. The mirror in the second traveling body 34 reflects the light. The reflected light passes through the imaging lens 35 and enters the reading sensor 36. The reading sensor 36 then constructs image information based on the entered light.

In parallel with the original reading operation, each element in the process cartridges 18Y, 18M, 18C and 18K, the intermediate transfer unit 17, the secondary transfer device 22 and the fixing device 25 begin to drive. The optical writing unit 21 is controlled based on the image information constructed by the reading sensor 36, and the toner images Y, M, C and K are formed on the respective photoconductor drums 1Y, 1M, 1C and 1K. The toner images Y, M, C and K are superimposed and transferred onto the intermediate transfer belt 110 to form the four color toner image.

The sheet feeder 200 begins a feeding operation therewithin at substantially the same time as the beginning of the original reading operation. In the feeding operation, one of the sheet feed rollers is selected and rotated, and the transfer sheets are fed from one of the sheet cassettes 44 installed in the sheet bank 43. The sheet separation roller 45 separates the transfer sheets one by one so that each transfer sheet is put into the feed path 46 and is conveyed toward the secondary transfer nip by the conveyance rollers 47. The transfer sheets can be fed from a manual feeding tray 51, substituting for the sheet cassettes 44. For example, when the transfer sheet is fed from the manual feeding tray 51, a manual feed roller 50 is selected and rotated to feed the transfer sheets on the manual feeding tray 51 into a separation roller 52. The separation roller 52 separates the transfer sheets one by one, and each separated transfer sheet is fed into a manual feed path 53.

When the image forming apparatus 500 forms a multicolor image with at least two different toner colors, the intermediate transfer belt 110 is tightly stretched in such a manner that the upper stretch surface thereof becomes horizontal. In this regard, the photoconductor drums 1Y, 1M, 1C and 1K contact the stretched upper surface of the intermediate transfer belt 110. By contrast, when the image forming apparatus 500 forms a monochrome image with the black toner, the intermediate transfer belt 110 is positioned in such a manner as to incline toward the lower left of FIG. 4 using a mechanism, not shown. Therefore, the stretched upper surface of the intermediate transfer belt 110 is separated from the photoconductor drums 1Y, 1M and 1C. The photoconductor drum 1K rotates counterclockwise while contacting the stretched upper surface of the intermediate transfer belt 110 so that the toner image K is formed thereon. During the monochrome image formation, the photoconductor drums 1Y, 1M and 1C and the development devices 4Y, 4M and 4C halt, thereby reducing unnecessary consumption of toner and unnecessary abrasion of the photoconductor drums. A description of the development devices 4Y, 4M, 4C and 4K is given below with reference to FIG. 5 by using a development device 4 as representative of the development devices 4Y, 4M, 4C and 4K.

The image forming apparatus 500 includes a control unit, not shown, and an operation display unit, not shown. The control unit includes a CPU, and the operation display unit includes a liquid crystal display and key buttons. For example, when a user inputs a key to the operation display unit, a command is sent to the control unit so that the user can select one of three one-sided print modes, such as a direct ejection mode, a reverse ejection mode, and a reverse decor ejection mode, to form the toner image on one side of the transfer sheet.

Figure 5:
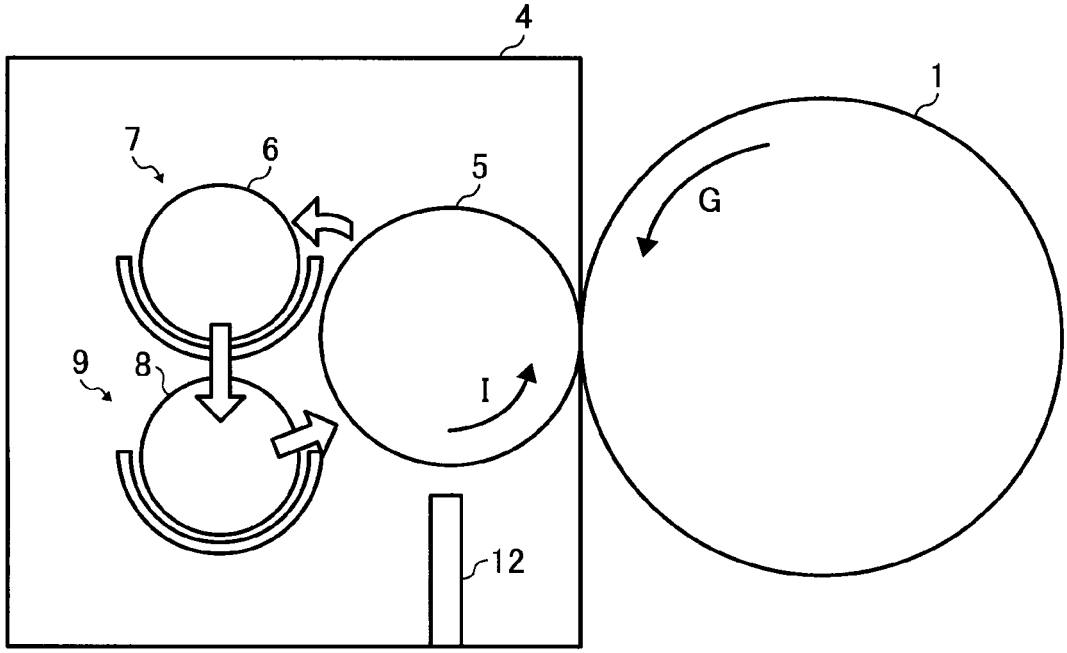
FIG. 5 is a schematic diagram illustrating a development device of the image forming apparatus of FIG. 4.

FIG. 5 illustrates the development device 4 of the image forming apparatus 500. The process cartridges 18Y, 18M, 18C and 18K shown in FIG. 4 include the development devices 4Y, 4M, 4C and 4K and the photoconductor drums 1Y, 1M, 1C and 1K, respectively. In FIG. 5, since each of the development devices 4Y, 4M, 4C and 4K is similar to every other except for the color of the toner, and each of the photoconductor drums 1Y, 1M, 1C and 1K is also similar to every other except for the color of the toner, the color abbreviations are omitted for the sake of simplicity.

The photoconductor drum 1 rotates in a direction indicated by an arrow G shown in FIG. 5 to charge a surface thereof with the charging device. The surface of the photoconductor drum 1 is irradiated by the laser beam from the optical writing unit 21 shown in FIG. 4 so as to form the electrostatic latent image thereon. The development device 4 develops the electrostatic latent image on the photoconductor drum 1 with the developer including the toner, thereby forming the toner image.

The development device 4 includes a development roller 5, a supply screw 8, a development doctor 12, a collection screw 6, a supply conveyance path 9, and a collection conveyance path 7.

The development roller 5 serving as a developer carrying member supplies the toner to the electrostatic latent image on the surface of the photoconductor drum 1 while moving a surface thereof in a direction indicated by an arrow I shown in FIG. 5. The supply screw 8 serving as a developer supply conveyance member conveys the developer to a rear side of FIG. 5 while supplying it to the development roller 5.

The development doctor 12 serving as a developer regulation member adjusts a thickness of the developer supplied to the development roller 5 to a suitable level for development. The development doctor 12, which is made of stainless steel, is located at a downstream side from a facing position, in which the development roller 5 faces the supply screw 8, relative to a surface movement direction of the development roller 5 as shown in FIG. 5. The development doctor 12 regulates the developer so as to deposit a thin layer of developer on the development roller 5. The thin layer of developer is conveyed to a development region H in which the development roller 5 faces the photoconductor drum 1 for the development. A description of the development region H is given below with reference to FIG. 6. The surface of the development roller 5 can include a V-groove or can be sandblasted. The development roller 5 includes an aluminum tube with a diameter of 25 mm. The developer roller 5 and the developer doctor 12 have a gap therebetween, and the developer roller 5 and the photoconductor drum 1 have another gap therebetween. Each of the gaps is approximately 0.3 mm.

The collection screw 6 serving as a developer collection conveyance member collects collection developer that has passed the development region H and conveys it in a direction opposite the supply screw 8. The collection screw 6 is located at the downstream side from the development region H relative to the surface movement direction of the development roller 5. Each of the supply screw 8 and the collection screw 6 is comprised of resin, and each screw has a diameter of 18 mm, a screw pitch of 25 mm, and an approximate rotation speed of 600 rpm (rotations per minute).

As shown in FIG. 5, the supply conveyance path 9 includes the supply screw 8 and is disposed obliquely below the development roller 5. The collection conveyance path 7 includes the collection screw 6 and is disposed above the supply conveyance path 9. The collection conveyance path 7 and the supply conveyance path 9 communicate with each other through supply openings 91 and 91' and excess developer openings 92 and 92', described with reference to FIG. 6.

Figure 6:
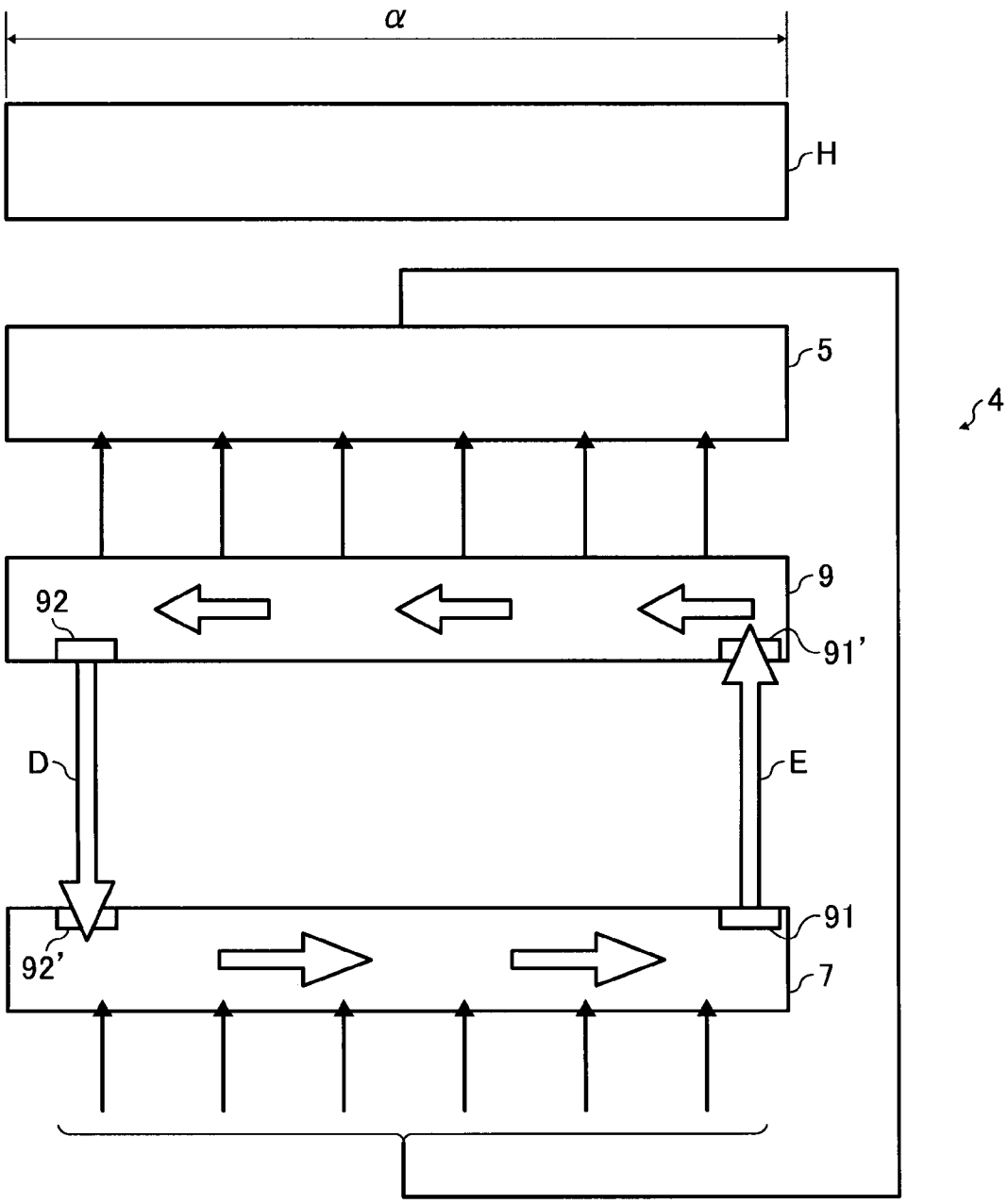
FIG. 6 is a schematic diagram illustrating a flow of developer in the development device of FIG. 5.

FIG. 6 schematically illustrates a flow of the developer within the development device 4 of FIG. 5. Each arrow in FIG. 6 represents a direction of movement of the developer.

In the development device 4, the collection conveyance path 7 includes the supply opening 91 and the supply conveyance path 9 includes the supply opening 91', so that the developer is supplied from the downstream side of the collection conveyance path 7 to the upstream side of the supply conveyance path 9. The supply conveyance path 9 includes an excess developer opening 92 and the collection conveyance path 7 includes the excess supply opening 92', so that the developer including any excess developer is supplied from the downstream side of the supply conveyance path 9 to the upstream side of the collection conveyance path 7. Excess developer refers to developer conveyed to the downstream of the supply conveyance path 9 without being supplied to the development roller 5. The development roller 5 supplies the developer to the photoconductor drum 1 in the development region H. As shown in FIG. 6, the development region H includes a development region width a that is a width in an axial direction of the rotation axis of the development roller 5. The supply openings 91 and 91' and the excess developer openings 92 and 92' are positioned within the width $\alpha$.

The supply conveyance path 9 conveys the developer to the downstream side thereof relative to the developer conveyance direction while supplying the developer to the development roller 5 with the supply screw 8. Since the supply screw 8 rotates, the excess developer is lifted and supplied to the downstream side of the supply conveyance path 9 relative to the developer conveyance direction and to the collection conveyance path 7 through the excess developer openings 92 and 92'. Such a movement of the excess developer through the excess developer openings 92 and 92' is indicated by an arrow D shown in FIG. 6. The development doctor 12 of FIG. 5 regulates the thickness of the developer supplied to the development roller 5 from the supply conveyance path 9 even when the developer at the downstream side of the supply conveyance path 9 is lifted, thereby reducing the occurrence of images of uneven density.

The collection conveyance path 7 conveys the excess developer supplied from the supply conveyance path 9 and the developer collected from the developer roller 5 while agitating them with the collection screw 6. The agitated developer is then conveyed to the downstream end of the collection conveyance path 7 relative to the developer conveyance direction. Subsequently, the agitated developer is supplied to the supply conveyance path 9 through the supply openings 91 and 91' indicated by an arrow E shown in FIG. 6. In other words, the agitated developer falls to the supply conveyance path 9 from the collection conveyance path 7 through the supply openings 91 and 91'. The collection conveyance path 7 has the supply opening 91 at the downstream side thereof relative to the developer conveyance direction, thereby reducing a frequency of the excess supply of the developer therewithin. Consequently, the supply conveyance path 9 is unlikely to supply low-density developer to the development roller 5. In addition, the collection conveyance path 7 conveys the collection developer, the excess developer, and any additional toner described later while agitating them with the collection screw 6.

The development device 4 includes a toner density sensor, not shown, disposed below the collection conveyance path 7. The toner density sensor outputs a sensor to activate a toner supply controller, not shown, that controls a supply of the additional toner from a toner container, not shown, having a toner supply opening, not shown. The toner supply opening will be described later.

Figure 7:
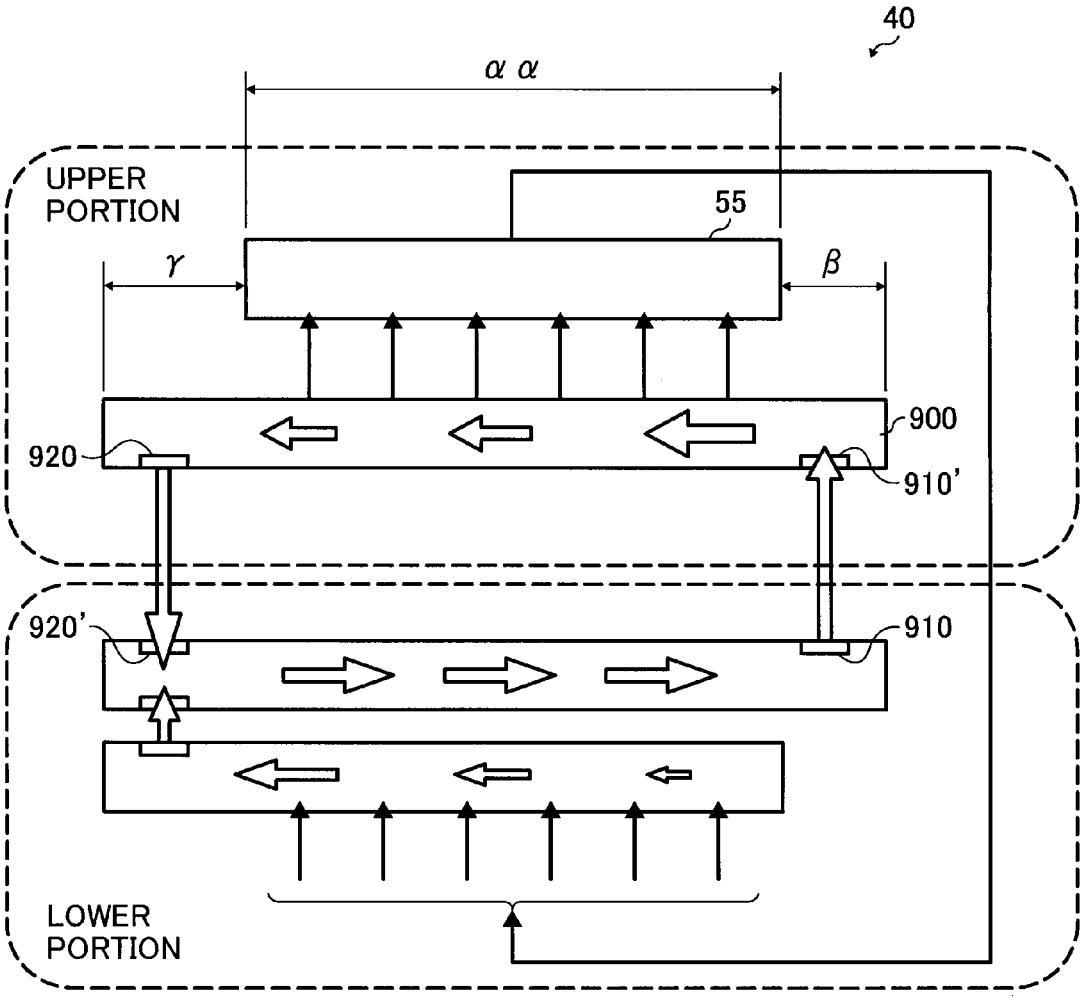
FIG. 7 is a schematic diagram illustrating a flow of developer in another related-art development device.

FIG. 7 illustrates the flow of developer within a related-art development device 40.

The related-art development device 40 includes supply openings 910 and 910' and excess developer openings 920 and 920' disposed outside a development region width $\alpha\alpha$. Since the supply openings 910 and 910' are disposed outside the width $\alpha\alpha$, a supply conveyance path 900 at an upstream side thereof relative to a developer conveyance direction is longer than a development roller 55 by an amount $\beta$. Since the excess developer openings 920 and 920' are also disposed outside the width $\alpha\alpha$, the supply conveyance path 900 at a downstream side thereof relative to the developer conveyance direction is longer than the development roller 55 by an amount $\gamma$. The $\beta$ and $\gamma$ are respectively referred to as a supply conveyance path upstream side region and a supply conveyance path downstream side region.

Compared to the development device 40 of FIG. 7, the development device 4 of the exemplary embodiment shown in FIG. 6 includes the supply openings 91 and 91' and the excess developer openings 92 and 92' disposed within the width $\alpha$. In this regard, the supply conveyance path 9 at the upstream side thereof relative to the developer conveyance direction can be shorter than the supply conveyance path 900 of the related-art development device 40 by an amount $\beta$. Similarly, the supply conveyance path 9 at the downstream side thereof relative to the developer conveyance direction can be shorter than the supply conveyance path 900 of the related-art development device 40 by an amount $\gamma$.

Therefore, the development device 4 of the exemplary embodiment can be made more compact than the related-art development device 40.

A description is now given of the toner supply opening of the development device 4 of the exemplary embodiment of the present invention.

The toner supply opening supplies the additional toner to a developer conveyance path including the supply conveyance path 9 and the collection conveyance path 7 of the development device 4. The toner supply opening is disposed at the upstream side of the collection conveyance path 7 relative to the developer conveyance direction within the width a so that the development device 4 and the image forming apparatus 500 can reduce the size thereof. Moreover, the development device 4 can secure an agitation conveyance distance to disperse the additional toner into the developer within the collection conveyance path 7.

The toner supply opening can be disposed at the upstream side from the excess developer opening 92' of the collection conveyance path 7 relative to the developer conveyance direction. For example, the toner supply opening can be disposed in a space generated by disposing the excess developer opening 92' within the width $\alpha$. The development device 4 with such a disposition of the toner supply opening can be smaller than the related-art development device 40. In addition, since the toner supply opening is disposed outside the width of each conveyance path, the additional toner can not only be supplied easily but also the agitation conveyance distance can be increased, thereby mixing the additional toner and the developer sufficiently.

According to the above-described embodiment, the development device 4 includes the development roller 5, the supply conveyance path 9, the collection conveyance path 7, the supply openings 91 and 91', and the excess developer openings 92 and 92'.

The development roller 5 serving as the developer carrying member rotates while carrying thereon the developer having the toner and the carrier, and supplies the toner to the electrostatic latent image on the surface of the photoconductor drum 1 at the opposing position, in which the development roller 5 faces the photoconductor drum 1, to develop the electrostatic latent image.

The supply conveyance path 9 includes the supply screw 8 supplying the developer to the development roller 5, and conveys the developer in an axial direction of the development roller 5.

The collection conveyance path 7 includes the collection screw 6 collecting the collection developer from the development roller 5 having passed the position opposite the photoconductor drum 1, and conveys the collection developer in the axial direction of the development roller 5 in an opposite direction relative to the supply screw 8.

The supply openings 91 and 91' serving as first and third openings communicate with the downstream side of the collection conveyance path 7 relative to the developer conveyance direction with the upstream side of the supply conveyance path 9 relative to the developer conveyance direction. In the exemplary embodiment as shown in FIG. 6, the supply openings 91 and 91' are separately disposed in the respective paths. However, the supply openings 91 and 91' can be integrated when a lower portion of the collection conveyance path 7 and an upper portion of the supply conveyance path 9 are adjacent to each other or contact each other. The excess developer openings 92 and 92' serving as fourth and second openings communicate with the downstream side of the supply conveyance path 9 relative to the developer conveyance direction with the upstream side of the collection conveyance path 7 relative to the developer conveyance direction. In the exemplary embodiment as shown in FIG. 6, the excess developer openings 92 and 92' are separately disposed in the respective paths. However, the excess developer openings 92 and 92' can be integrated when a lower portion of the collection conveyance path 7 and an upper portion of the supply conveyance path 9 are adjacent to each other or contacted with each other.

The collection conveyance path 7 is disposed obliquely above the development roller 5. The supply conveyance path 9 is disposed below the collection conveyance path 7. The supply openings 91 and 91' and the excess developer openings 92 and 92 are disposed within the width α which is the width in the axial direction of the rotation axis of the development roller 5 of the development region H in which the toner is supplied to the photoconductor drum 1. Since the supply openings 91 and 91' and the excess developer openings 92 and 92' are disposed within the width α, the development device 4 can be smaller than a related-art development device such as the related-art development device 40 having the openings 910, 910', 920 and 920' outside the width αα. In addition, the developer falls from the supply opening 91 at the downstream side of the collection conveyance path 7 relative to the developer conveyance direction to the supply conveyance path 9 so that the collection conveyance path 7 can reduce the developer accumulation at the downstream thereof relative to the developer conveyance direction. Therefore, the collection conveyance path 7 can reduce the excess supply of the developer therewithin. Consequently, the development roller 5 can reduce the supply of the low-density collection developer thereto from the collection conveyance path 7 through the supply conveyance path 9. Therefore, the development device 4 of the exemplary embodiment of the present invention can not only reduce the size thereof but can also reduce a frequency of the uneven density image caused by the low-density collection developer being supplied to the development roller 5.

According to the above-described embodiment, the development device 4 includes the development doctor 12 serving as the developer regulation member which regulates the thickness of the developer supplied to the development roller 5 to be the appropriate level. The development doctor 12 is disposed below the development roller 5. Therefore, the development doctor 12 can regulate the thickness of the developer supplied to the development roller 5 from the supply conveyance path 9 at the appropriate level even when an excess amount of the developer is supplied from the supply conveyance path 9 to the development roller 5 caused by the excess supply of the developer within the supply conveyance path 9, thereby reducing a frequency of the uneven density image.

According to the above-described embodiment, the toner supply opening, which supplies the additional toner to the collection conveyance path 7, is disposed at the upstream side of the collection conveyance path 7 relative to the developer conveyance direction. Therefore, the development device 4 can save the space thereof and can secure the agitation conveyance distance to disperse the additional toner into the developer within the collection conveyance path 7.

According to the above-described embodiment, the toner supply opening is disposed at the upstream side from the excess developer opening 92' of the collection conveyance path 7 relative to the developer conveyance direction. Since the toner supply opening is disposed outside the width of each conveyance path, the additional toner can not only be supplied easily but also the agitation conveyance distance can be increased, thereby mixing the additional toner and the developer sufficiently.

According to the above-described embodiment, the development device 4 and at least one of the development elements selected from the photoconductor drum 1, the charging device and the drum cleaning device are integrally supported to form the process cartridge 18, which is detachably installed in the image forming apparatus 500. The employment of the process cartridge 18 provides the same effects as described above and can enhance maintainability.

According to the above-described embodiment, the image forming apparatus 500 includes the development device 4 so as to permit the same effects provided by the development device 4, thereby providing good image forming.

According to the above-described embodiment, the image forming apparatus 500 includes the process cartridge 18 including the development device 4, thereby permitting the same effects provided by the development device 4. Therefore, the image forming apparatus 500 can provide good image formation and can enhance maintainability by employing the process cartridge 18.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A development device comprising:

a developer carrying member configured to rotate while bearing thereon a developer including a toner and a carrier to carry the developer to a development region, in which the developer carrying member is disposed opposite a latent image carrier and develops a latent image on the latent image carrier;

a developer collection conveyance path including a developer collection conveyance member collecting the developer from the developer carrying member after the developer on the developer carrying member passes through the development region, the developer collection conveyance path disposed obliquely above the developer carrying member and configured to convey the collected developer in a first direction parallel to an axis of the developer carrying member and having first and second openings within a development region width; and a developer supply conveyance path including a developer supply conveyance member supplying the developer to the developer carrying member, the developer supply conveyance path disposed below the developer collection conveyance path and configured to convey the developer in a second direction opposite to the first direction, the developer supply conveyance path having third and fourth openings within the development region width, the developer on a downstream side of the developer collection conveyance path conveyed by the developer collection conveyance path being transferred to an upstream side of the developer supply conveyance path through the first and third openings, the developer on a downstream side of the developer supply conveyance path conveyed by the developer supply conveyance path being transferred to an upstream side of the developer collection conveyance path through the fourth and second openings.

2. The development device of claim 1 further comprising a developer regulation member configured to regulate a thickness of the developer carried on the developer carrying member, the developer regulation member disposed below the developer carrying member.

3. The development device of claim 1 further comprising a toner supply member configured to supply an additional toner to the developer collection conveyance path, the toner supply member disposed at an upstream side of the developer collection conveyance path relative to the developer conveyance direction.

4. The development device of claim 3, wherein the toner supply member is disposed at an upstream side from the second opening of the developer collection conveyance path relative to the developer conveyance direction.

5. A process cartridge detachably installed in an image forming apparatus, the process cartridge comprising:

at least one member selected from a group consisting of a latent image carrier configured to carry a latent image thereon, a charging member configured to charge the latent image carrier, and a cleaning member configured to clean a surface of the latent image carrier; and a development device configured to develop the latent image with a developer including a toner and a carrier, the development device comprising:

a developer carrying member configured to rotate while bearing thereon the developer to carry the developer to a development region, in which the developer carrying member is disposed opposite the latent image carrier and develops the latent image on the latent image carrier, a developer collection conveyance path including a developer collection conveyance member collecting the developer from the developer carrying member after the developer on the developer carrying member passes through the development region, the developer collection conveyance path disposed obliquely above the developer carrying member and configured to convey the collected developer in a first direction parallel to an axis of the developer carrying member, wherein the developer collection conveyance path has a first and second openings within a development region width, and a developer supply conveyance path including a developer supply conveyance member supplying the developer to the developer carrying member, the developer supply conveyance path disposed below the developer collection conveyance path and configured to convey the developer in a second direction opposite to the first direction, wherein the developer supply conveyance path has third and fourth openings within the development region width, wherein the developer on a downstream side of the developer collection conveyance path conveyed by the developer collection conveyance path is transferred to an upstream side of the developer supply conveyance path through the first and third openings, and the developer on an upstream side of the developer supply conveyance path conveyed by the developer supply conveyance path is transferred to an upstream side of the developer collection conveyance path through the fourth and second openings.

6. An image forming apparatus comprising:

a latent image carrier configured to carry a latent image thereon; and a development device configured to develop the latent image with a developer including a toner and a carrier, the development device comprising:

a developer carrying member configured to rotate while bearing thereon the developer to carry the developer to a development region, in which the developer carrying member faces the latent image carrier to develop the latent image on the latent image carrier, a developer collection conveyance path including a developer collection conveyance member collecting the developer from the developer carrying member after the developer on the developer carrying member passes through the development region, the developer collection conveyance path disposed obliquely above the developer carrying member and configured to convey the collected developer in a first direction parallel to an axis of the developer carrying member, wherein the developer collection conveyance path has first and second openings within a development region width, and a developer supply conveyance path including a developer supply conveyance member supplying the developer to the developer carrying member, the developer supply conveyance path disposed below the developer collection conveyance path and configured to convey the developer in a second direction opposite to the first direction, wherein the developer supply conveyance path has third and fourth openings within the development region width, wherein the developer on a downstream side of the developer collection conveyance path conveyed by the developer collection conveyance path is transferred to an upstream side of the developer supply conveyance path through the first and third openings, and the developer on an upstream side of the developer supply conveyance path conveyed by the developer supply conveyance path is transferred to an upstream side of the developer collection conveyance path through the fourth and second openings.

7. The image forming apparatus of claim 6, further comprising:

a charging member configured to charge the latent image carrier; and a cleaning member configured to clean a surface of the latent image carrier the development device and at least one member selected from a group consisting of the latent image carrier, the charging member, and the cleaning member being integrally supported to form a process cartridge detachably installed therein.

* * * * *